United States Patent [19]

Kickle et al.

[11] Patent Number: 4,675,127

[45] Date of Patent: Jun. 23, 1987

[54] PROCESS FOR PREPARING PARTICULATE DETERGENT COMPOSITIONS

[75] Inventors: Hunter L. Kickle, Mt. Zion; Allen D. Urfer, Decatur, both of Ill.; Arno Cahn, Pearl River, N.Y.; Nelson F. Borys; Gilles M. L. Verboom, both of Decatur, Ill.

[73] Assignee: A. E. Staley Manufacturing Company, Decatur, Ill.

[21] Appl. No.: 781,273

[22] Filed: Sep. 26, 1985

[51] Int. Cl.[4] ..... C11D 11/02

[52] U.S. Cl. ..... 252/174.17; 252/135; 252/174.21; 252/537; 252/540; 252/558; 252/559

[58] Field of Search ..... 252/135, 140, 174.17, 252/174.21, 537, 540, 558, 559

[56] References Cited

U.S. PATENT DOCUMENTS

| | | | |
|---|---|---|---|
| 4,396,520 | 8/1983 | Payne et al. | 252/550 |
| 4,416,792 | 11/1983 | Blackstone | 252/110 |
| 4,482,470 | 11/1984 | Reuter et al. | 252/162 |
| 4,483,780 | 11/1984 | Llenado | 252/174.17 |
| 4,488,981 | 12/1984 | Urfer et al. | 252/174.17 |
| 4,536,319 | 8/1985 | Payne | 252/174.17 |

FOREIGN PATENT DOCUMENTS 0075996 4/1983 European Pat. Off. .

*Primary Examiner*—Paul Lieberman
*Assistant Examiner*—Hoa Van Le
*Attorney, Agent, or Firm*—James B. Guffey; Michael F. Campbell; J. Daniel Wood

[57] ABSTRACT

Particulate detergent compositions are prepared by (a) forming an aqueous crutcher slurry having a total solids content of from about 40 to about 80 weight percent on a total weight basis and comprising a surfactant ingredient, al least about 0.1 weight percent (surfactant weight basis) of which is a glycoside surfactant; a builder ingredient; water; and, optionally, a filler ingredient and (b) thereafter drying said aqueous crutcher slurry. In an especially preferred embodiment, the glycoside surfactant is employed as an additive in a relatively small but effective amount (i.e., corresponding to less than about 2 weight percent on a dry solids weight basis) to provide reduced viscosity and/or enhanced homogeneity to the crutcher slurry compositions of interest.

18 Claims, No Drawings

PROCESS FOR PREPARING PARTICULATE DETERGENT COMPOSITIONS

BACKGROUND OF THE INVENTION

The present invention pertains generally to a process for the preparation of particulate (e.g., granular, powdered, flaked, etc.) detergent compositions by preparing a relatively high solids aqueous crutcher slurry containing surfactant, builder and, optionally, filler ingredients and subsequently drying same to produce the desired particulate detergent product. More particularly, the present invention pertains to such a process in which said crutcher slurry comprises at least about 0.1 weight percent of a glycoside surfactant on a total surfactant component weight basis.

In the manufacture of powdery or granular detergent compositions, it is common practice to prepare a relatively high solids aqueous crutcher slurry comprising a surfactant ingredient, a builder ingredient and water and to spray dry said crutcher slurry to form the desired powdery or granular detergent product.

When preparing a powdered or granular detergent product in the foregoing fashion, there is significant economic incentive to minimize the amount of water present in (and to maximize the dry solids content of) said crutcher slurry and to thereby reduce or minimize the amount of energy required in drying same to form the desired granular or powdered detergent product. Naturally, however, there are also practical upper limits within actual granular or powdered detergent manufacturing operations upon the maximum solids content which can be achieved while still providing a pumpable/sprayable slurry as well as upon the combinations of ingredients (e.g., surfactants, builders, etc.) suitable for preparing stable, homogeneous high solids aqueous crutcher slurries or suspensions. Thus, for example, while anionic surfactant-based crutcher slurries, are generally homogeneous, stable suspensions which are suitable for spray drying, they tend to become too viscous to handle at high solids levels (such as, for example, at solids levels in excess of 65 to 67 weight percent on a total weight basis).

On the other hand, at least certain types of builder/-nonionic surfactant (e.g., ethoxylated fatty alcohol surfactants) combinations appear to generally be unsuitable for use in the above-indicated fashion by virtue of failing to provide a stable, homogeneously suspended crutcher slurry composition.

In view of the foregoing limitations of prior art systems, it would be high desirable to provide an improved process for preparing powdered or granular detergent compositions. In particular, it would be highly desirable to provide a means by which anionic surfactant-based crutcher slurry having increased solids content could be prepared without an attendant unacceptable increase in the viscosity of said slurry. Similarly, it would be quite desirable to provide a means to facilitate the preparation of a relatively high solids content nonionic surfactant-based crutcher slurry in stable, homogeneous form utilizing ingredients which do not normally provide stable, homogeneously suspended crutcher slurry compositions.

Prior attempts to overcome the aforementioned phase separation problem in nonionic surfactant-based crutcher slurries have included the incorporation of certain surface active iminodipropionate compounds as discussed in U.S. Pat. No. 4,416,792 to Blackstone (issued Nov. 22, 1983).

The problem of excessive viscosity in anionic surfactant-based crutcher slurries is addressed in U.S. Pat. No. 4,482,470 to Reuter et al (issued Nov. 13, 1984) by including within said crutcher slurry a small amount of a compound containing polyglycol ether groups specifically certain polyethylene glycols, certain polypropylene glycols and certain ethoxylated aliphatic alcohol or alkyl phenol compounds.

Another approach conventionally employed in the art is the use of sodium toluene (or xylene) sulfonate as a hydrotrope in detergent crutcher slurry compositions.

SUMMARY OF THE INVENTION

It has now been discovered that noteworthy improvements can be achieved in the manufacture of particulate (e.g., powdered, flaked, granular etc.) detergent compositions pursuant to the process noted above when a glycoside surfactant is included within the aqueous crutcher slurry prior to the drying thereof. Thus, in one of its broader aspects, the present invention is a process for the preparation of a particulate detergent composition which comprises the steps of:

A. forming an aqueous crutcher slurry comprising, per 100 parts of total crutcher slurry weight:
   1. from about 40 to about 80 parts by weight of solid ingredients, said solid ingredients comprising:
      a. from about 2 to about 60 parts by weight of a surfactant ingredient, at least about 0.1 weight percent of which is a glycoside surfactant;
      b. from about 5 to about 70 parts by weight of a builder ingredient; and
      c. from 0 to about 40 parts by weight of a water soluble filler ingredient; and
   2. from about 20 to about 60 parts by weight of water; and B. drying said crutcher slurry to form said particulate detergent composition.

In one particularly preferred embodiment of the invention, the surfactant ingredient is predominantly composed of (i.e., at least about 50 weight percent of the surfactant ingredient is) an anionic surfactant and the glycoside surfactant is employed in an amount sufficient to measurably reduce the crutcher slurry viscosity.

In another particularly preferred embodiment, the predominant (at least about 50 weight percent on a surfactant weight basis) surfactant ingredient is a conventional non-glycoside nonionic surfactant and the glycoside surfactant is employed in an amount sufficient to substantially improve the homogeneity of the resulting crutcher slurry.

In an especially preferred embodiment hereof, the aforementioned glycoside surfactant is employed in an amount which constitutes less than about 2 weight percent of said solid ingredients on a total dry solids weight basis.

DETAILED DESCRIPTION OF THE INVENTION

An initial step in the process of the present invention is the formation of a relatively high solids content (e.g., from about 40 to about 80 weight percent solids on a total weight basis) aqueous crutcher slurry which comprises a surfactant ingredient, a builder ingredient and water and which can also contain additional optional ingredients such as water soluble filler materials and the like.

In order to perform satisfactorily in the process of interest, the indicated crutcher slurries need to take the form of relatively stable homogeneous dispersions or suspensions which do not tend to rapidly separate upon standing without vigorous agitation and which are sufficiently fluid to permit (i.e., which are not so viscous as to prevent) the pumping and drying (especially spray drying) of same.

In the case of anionic surfactants such as linear or branched alkyl aryl sulfonates or derivatives thereof (e.g., alkyl benzene sulfonates, alkyl toluene sulfonates, alkyl phenol sulfonates, etc.); metal (especially alkali metal) salts of fatty acids (commonly referred to as "soaps"); alcohol sulfates; alcohol ether sulfates; alkanesulfonates; alkenesulfonates; alpha sulfo methyl fatty esters; and the like, crutcher slurries prepared therewith tend to become too viscous for suitable handling (e.g., pumping and spraying) at solids contents in excess of from about 65 to 67 weight percent on a total slurry weight basis. In accordance with this invention, the inclusion of a relatively small but effective amount (i.e., a "viscosity reducing amount") of a glycoside surfactant within such anionic surfactant-based crutcher slurries provides notably reduced slurry viscosity at a given total solids content within said slurry.

In the case of nonionic surfactants such as alkoxylated (especially ethoxylated and mixed ethoxylated/-propoxylated adducts) primary or secondary fatty (e.g., $C_8$-$C_{20}$) alcohols, alkoxylated alkyl phenols, fatty alkanolamides, etc., aqueous crutcher slurries prepared therewith oftentimes exhibit a pronounced tendency to phase separate upon standing for a relatively short time without vigorous agitation. Such phase separation is highly undesirable since it can result in non-homogeniety in the final particulate product and/or in safety concerns relating to potential ignition and combustion of phase-separated flammable ingredients within spray drying towers, etc. This phase separation propensity is substantially alleviated or eliminated in accordance with the present invention by the inclusion within said nonionic surfactant-based crutcher slurries of a relatively small but effective amount (i.e., a "homogenizing amount") of a glycoside surfactant.

Glycoside surfactants suitable for use in accordance with the present invention include those of the formula:

$$RO—R^1O—_y(Z)_x \qquad A$$

wherein R is a monovalent organic radical containing from about 6 to about 30 (preferably from about 8 to about 18) carbon atoms; $R^1$ is a divalent hydrocarbon radical containing from about 2 to about 4 carbon atoms; O is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the Formula A above in which R is a monovalent organic radical (linear or branched) containing from about 6 to about 18 (especially from about 8 to about 18) carbon atoms; y is zero; z is glucose or a moiety derived therefrom; x is a number having an average value of from 1 to about 4 (preferably from about 1½ to 4).

Glycoside surfactants suitable for use herein also include those of the Formula A above in which one or more of the normally free (i.e. unreacted) hydroxyl groups of the saccharide moiety, Z, have been alkoxylated (preferably, ethoxylated or propoxylated) so as to attach one or more pendant alkoxy or poly (alkoxy) groups in place thereof. In such event, the amount of alkylene oxide (e.g., ethylene oxide, propylene oxide, etc.) employed will typically range from about 1 to about 20 (preferably from about 3 to about 10) moles thereof per mole of saccharide moiety within the Formula A glycoside material.

In glycosides of the Formula A above, the $RO(R^1O)_y$ group is generally bonded or attached to the number 1 carbon atom of the saccharide moiety, Z. Accordingly, the free hydroxyls available for alkoxylation are typically those in the number 2, 3, 4 and 6 positions in 6-carbon atom saccharides and those in the number 2, 3 and 4 positions in 5-carbon atom saccharide species. Typically, the number 2 position hydroxyls in 5-carbon saccharides, and the number 2 and 6 position hydroxyls in 6-carbon saccharides, are substantially more reactive or susceptible to alkoxylation than those in the number 3 and 4 positions. Accordingly, alkoxylation will usually occur in the former locations in preference to the latter. Examples of the indicated alkoxylated glycoside materials, and of methodology suitable for the preparations of same, are described in U.S. patent application Ser. No. 06/704,828 filed Feb. 22, 1985 by Roth et al.

The amount of surfactant ingredient employed within the crutcher slurry can vary considerably in accordance with the practice of the present invention. However, as a general rule said surfactant ingredient will typically be employed in an amount ranging from about 2 to about 60 (preferably from about 4 to about 25 and most preferably from about 5 to about 20) parts by weight per 100 parts by weight of said crutcher slurry.

Generally speaking, the glycoside surfactant is typically employed in an amount corresponding to at least about 0.1 weight percent (preferably at least about 1 weight percent) on a total surfactant ingredient weight basis and in many instances is beneficially employed in an amount ranging from about 1 to about 50 (more preferably from about 2 to about 40 and most preferably from about 5 to about 20) weight percent on a total surfactant ingredient weight basis. In some instances, however, the preferred or optimum amount of glycoside surfactant to be employed will vary dramatically depending upon the nature of the powdered or granular detergent product which is desired to be produced in accordance herewith. For example, certain peculiar and surprising viscosity behavior has been observed for high solids crutcher slurries comprising mixtures of anionic surfactants and the above-described glycoside surfactants. More specifically, while it has been observed that reduced viscosity benefits are imparted to anionic surfactant-based crutcher slurries at essentially any level of glycoside surfactant utilization therein (e.g., at anionic surfactant:glycoside surfactant ratios ranging from 99:1 to 1:99), it has also been unexpectedly found that the magnitude of viscosity reduction is the least at a 1:1 anionic surfactant to glycoside surfactant ratio and that crutcher slurry viscosity decreases (at a given solids level) as one moves in either direction (i.e., either toward a 99:1 or toward a 1:99 anionic surfactant to glycoside ratio) away from said 1:1 ratio. Such phenomenon is believed to be particularly surprising at anionic surfactant:glycoside ratios in excess of 1:1 (e..g. 1:1 to 99:1) since within that range the addition of lesser and lesser proportions of the inherently less viscous material (i.e., the glycoside) provides progressively more and more dramatic viscosity reduction benefits.

Thus, in the case of anionic surfactant-based crutcher slurry compositions, it is generally preferred that the glycoside surfactant be employed in an amount either corresponding to an anionic surfactant to glycoside ratio of from about 99:1 to about 2:1 (more preferably from about 49:1 to about 3:1 and most preferably from about 19:1 to about 4:1) or corresponding to an anionic surfactant to glycoside ratio of from about 1:99 to about 25:75 (more preferably from about 2:98 to about 20:80 and most preferably from about 5:95 to about 15:85).

In those instances in which the crutcher slurry of interest is to be based upon a normally incompatible nonionic surfactant material (e.g., alkoxylated alcohol or alkyl phenol surfactants such as ethoxylated fatty alcohols, ethoxylated alkyl phenols, random or block condensation products of fatty alcohols or of alkyl phenols with both ethylene oxide and propylene oxide, and the like), the glycoside surfactant will be employed in an amount sufficient to prevent phase separation of the resulting crutcher slurry composition (i.e., in a "homogenizing amount"). In some instances, the amount of glycoside surfactant sufficient for such purpose will be as little as 1 or 2 weight percent on a total surfactant ingredient weight basis and in other instances the minimum amount of glycoside required to accomplish the indicated function will be in the range of at least about 10 or 15 or 20 weight percent on a total surfactant ingredient weight basis.

One embodiment of the present invention which is specifically contemplated (and which is of special interest) herein is that wherein the crutcher slurry nonionic surfactant ingredient consists essentially of (e.g., is composed exclusively of) a glycoside surfactant and wherein said crutcher slurry is substantially free of non-glycosidic surfactant components such as the above-described anionic surfactants and the above-described non-glycoside nonionic surfactants.

An especially preferred embodiment hereof is one in which the predominant surfactant component employed is either a conventional anionic surfactant, a conventional non-glycosidic nonionic surfactant or a combination thereof and in which the above-described glycoside surfactant is employed in relatively small (or "additive level") proportions. In such embodiment, the glycoside surfactant will generally constitute less than about 2 (preferably about 1.8 or less, more preferably about 1.6 or less and most preferably about 1.5 or less) weight percent of the solid ingredients within the crutcher slurry (or detergent composition) of interest on a total dry solids ingredient weight basis.

Builder ingredients suitable for use herein include the various known builder materials as are conventionally employed in the manufacture of powdered or granular detergent products. Examples of such builder ingredients (which, incidentally, may be used either individually or as mixtures of 2 or more in the usual fashion) include alkali metal phosphates such as sodium tripolyphosphate, potassium tripolyphosphate, sodium or potassium pyrophosphate, etc.; alkali metal carbonates; alkali metal citrates; alkali metal silicates; alkali metal nitrilotriacetates; carboxymethyloxy-succinates; Zeolites; and the like. Such builder ingredients are typically employed in the crutcher slurries hereof in an amount ranging from about 5 to about 70 (preferably from about 10 to about 60 and most preferably from about 12 to about 28) parts by weight per 100 parts by weight of the aqueous crutcher slurry composition. On a dry solids weight basis, said builder ingredient will typically constitute at least about 10 (preferably at least about 15 and most preferably at least about 20) weight percent of the subject detergent compositions. In especially preferred embodiments hereof, the builder ingredient will be employed in a weight ratio equal to or greater than 1:1 relative to the total weight of surfactant ingredient employed in the crutcher slurries of interest.

In connection with the above-discussed anionic surfactant-based crutcher slurry compositions, it has been observed that the viscosity reduction benefits (i.e., as are attained by the inclusion therein of a glycoside surfactant in accordance with the instant invention) tend to be most pronounced or dramatic in those instances wherein the builder ingredient employed comprises one or more alkali metal phosphate materials (especially sodium tripolyphosphate). Thus, those processes wherein that particular type of anionic surfactant-based crutcher slurry is employed represent embodiments which are of especial interest and significance in relation hereto. In such embodiments, the phosphate builder will typically constitute at least about 15 weight percent (oftentimes about 20 weight percent or more) of the composition on a total dry solids weight basis. Alkali metal silicate builder ingredients are oftentimes employed within the composition hereof at a level in excess of 3 weight percent (frequently in an amount of about 3.5 weight percent or more) on a total dry solids weight basis.

As in the case of conventional crutcher slurries, the crutcher slurries employed herein can suitably contain one or more of a fairly wide variety of the usual auxiliary or optional ingredients, additives or processing aids such as, for example, colorants; suds stabilizers; organic solvents; fluorescent whitening agents; bleaching agents; perfumes; antiredeposition aids such as carboxymethylcellulose, etc,; water soluble filler ingredients such as sodium chloride, sodium sulfate, etc,; and the like.

The indicated optional filler ingredients may be conveniently employed in amounts ranging from 0 to about 40 (preferably from 0 to about 32) parts by weight per 100 parts of total crutcher slurry weight and the various other auxiliary materials, if used, may conveniently range from 0 to about 30 (preferably from 0 to about 10, 15 or 20) parts by weight per 100 parts of total crutcher slurry weight.

The total dry solids content of the subject aqueous crutcher slurries is generally from about 40 to about 80 (preferably from about 50 to about 80 and most preferably from about 60 to about 75) parts by weight per 100 parts of total slurry weight and the water content of same typically ranges from about 20 to about 60 (preferably from about 20 to about 50 and most preferably from about 25 to about 40) parts by weight on a 100 part slurry weight basis.

The manner or order of combining of the above-described ingredients to prepare the crutcher slurry composition for use herein is not particularly critical. However, as a general rule it is convenient and preferred to initially admix together the water and any liquid ingredients (e.g., either inherently liquid ingredients or those which are normally purchased or otherwise obtained or used in the form of aqueous or non-aqueous solutions, dispersions, etc.) such as, for example, the surfactant ingredient, the glycoside surfactant and the like and to thereafter add (preferably with gentle agitation) to such initial admixture any normally solid powdery or granular ingredients such as water soluble inorganic filler materials, the desired builder ingredients and the like. Frequently, it may also be desirable to heat the initial aqueous mixture to an elevated temperature, e.g., from about 100° to about 200° F. (about 38° to about 93° C.) prior to adding the indicated filler and/or builder ingredients thereto. Such is especially preferred in the case of builder ingredients such as, for example, sodium tripolyphosphate wherein it is normally desired that the builder becomes at least partially (and preferably fully) hydrated (but not dissolved) during the course of the crutcher slurry preparation process.

Conversion of the above-described aqueous crutcher slurries into the ultimately desired particulate form can be suitably accomplished in any convenient, conventional fashion as may be desired to remove most, or substantial all, of the free water therefrom and to thereby provide a substantially dry particulate detergent product.

The drying process or technique most commonly practiced at the present time in the detergent manufacturing industry is that commonly designated as "spray drying" and such process or technique is the one of preferred choice in the practice of the present invention. Briefly stated, such process or technique generally involves the spraying of the crutcher slurry (or otherwise introducing same in the form of relatively small droplets) into a flowing stream (either concurrent or countercurrent) of a hot (e.g., from about 100° to 600° C.) gaseous drying fluid and maintaining said droplets in contact therewith for a time sufficient to vaporize and remove most or substantially all of the free water from said droplets. Such a process is frequently conducted in a vertical drying tower in which the crutcher slurry droplets are introduced at the top thereof and fall, via the pull of gravity, downwardly therethrough in contact with the indicated stream of hot gaseous drying fluid contained therein. Naturally, such process can be suitably conducted at substantially normal atmospheric pressure or substantially above or below atmospheric pressure as desired in a given instance. Typically, the crutcher slurry will have been preheated (e.g., to a temperature of from about 40 or 50 to about 90° or 95° C.) prior to its being fed to the spray drying process and frequently such is done in connection the preparation or formation of the crutcher slurry itself for other purposes as has been noted briefly above.

While the use of conventional spray drying techniques and equipment is generally preferred in connection with the present invention, it is nonetheless to be noted that the various other well known techniques of drying solutions, dispersions, suspensions, and the like to form substantially powdery, granular, flaked or other particulate forms of dry product therefrom can also be suitably employed to accomplish the requisite drying step of the present invention. Examples of such alternative drying processes or techniques suitable for use herein thus include drum drying, freeze drying, fluidized bed drying operations, and the like.

The particulate detergent compositions prepared in accordance with the present invention are suitable for ultimate use in the usual fashion in the various customary granular or powdery detergent applications such as, for example, in the laundering of clothes and other household textile articles, in automatic dishwashing detergent applications, in various institutional and/or industrial detergent applications and the like.

The present invention is further illustrated and understood by reference to the following examples thereof in which all parts and percentages are on a weight basis unless otherwise indicated.

EXAMPLES 1-6

In these examples, a series of glucoside surfactant-containing crutcher slurry compositions (Examples 1-5) containing about 67 weight percent solids on a total slurry weight basis are prepared and the viscosities thereof are determined (both as initially prepared and after 1.5 hours of aging) using a Brookfield viscometer. The compositional make-up of these various slurries and the viscosity results for same are summarized in Table A below.

In the preparation of such slurries, the water and the various ingredients employed in the form of aqueous solutions thereof (i.e., the linear alkyl benzene sulfonate, LAS, surfactant; the alkyl polyglucoside, APG, surfactant; and the sodium silicate material) are initially admixed together and are then heated to a temperature of about 165° F. (73.9° C.). Thereafter, all of the remaining dry solid ingredients (which are initially and thoroughly dry blended together prior to addition to the heated aqueous mixture) are added to and admixed with the heated aqueous mixture. The initial Brookfield viscosity of the resulting crutcher slurry is then determined at a temperature of about 165° F. (73.9° C.).

The resulting crutcher slurry is maintained at a temperature of about 165° F. (73.9° C.) for 1½ hours with periodic hand stirring and the Brookfield viscosity of each of the resulting aged slurries is again determined.

For the purpose of comparison, a corresponding 67% solids crutcher slurry is prepared wherein the surfactant ingredient is composed solely of the anionic LAS surfactant (Control 1) and a 74% solids 90:10 LAS:APG-based crutcher slurry (Example 6) is also prepared and subjected to viscosity evaluation. The recipes and viscosity results for these latter two slurry compositions are also summarized in Table A below.

TABLE A

| INGREDIENTS[1] | EXAMPLE 1 | EXAMPLE 2 | EXAMPLE 3 | EXAMPLE 4 | EXAMPLE 5 | CONTROL 1 | EXAMPLE 6 |
|---|---|---|---|---|---|---|---|
| LAS Anionic Surfactant[2] | None | 10.1 | 8.9 | 5.6 | 2.8 | 11.2 | 11.2 |
| Glucoside Surfactant[3] | 11.2 | 1.1 | 2.2 | 5.6 | 8.4 | None | 1.2 |
| Water | 33 | 33 | 33 | 33 | 33 | 33 | 26 |
| Sodium Silicate[4] | 2.6 | 2.6 | 2.6 | 2.6 | 2.6 | 2.6 | 2.9 |
| Sodium Tripoly-Phosphate (STPP) | 15.7 | 15.7 | 15.7 | 15.7 | 15.7 | 15.7 | 17.4 |
| NaCl | 7.0 | 7.0 | 7.0 | 7.0 | 7.0 | 7.0 | 7.7 |
| Carboxymethyl Cellulose (CMC) | 0.4 | 0.4 | 0.4 | 0.4 | 0.4 | 0.4 | 0.4 |
| $Na_2SO_4$ | 30.1 | 30.1 | 30.1 | 30.1 | 30.1 | 30.1 | 33.2 |
| Total Solids | 67% | 67% | 67% | 67% | 67% | 67% | 74% |

TABLE A-continued

| INGREDIENTS[1] | EXAMPLE 1 | EXAMPLE 2 | EXAMPLE 3 | EXAMPLE 4 | EXAMPLE 5 | CONTROL 1 | EXAMPLE 6 |
|---|---|---|---|---|---|---|---|
| % Glucoside Surfactant[5] | 100% APG | 10% APG | 20% APG | 50% APG | 75% APG | No APG | 10% APG |
| Viscosity[6] (poises) | | | | | | | |
| Initial | 102 | 180 | 385 | 390 | 420 | 485 | 490 |
| After 1.5 Hrs | 420 | 385 | 607 | 1,005 | 828 | 1,035 | 571 |

[1]Stated on an active ingredient content basis and in parts by weight.
[2]Linear $C_{12}$ alkyl benzene sulfonate (60% active aqueous solution).
[3]$C_{12}$–$C_{13}$ alkyl glucoside having a degree of polymerization of about 2.2–2.8 (50% active aqueous solution).
[4]46.5% active aqueous solution.
[5]Surfactant only weight basis.
[6]Brookfield viscometer, #75 spindle & 10 RPM.

As can be seen from the results in Table A, the inclusion of the alkyl polyglucoside (APG) surfactant at levels ranging from 10 to 100 weight percent (on a total surfactant ingredient weight basis) provided notably reduced crutcher slurry viscosities. Surprisingly, the addition of the APG surfactant at the relatively low levels of 10 and 20 weight percent provided substantially more dramatic viscosity reduction benefits than did the use thereof at the higher levels of 50 and 75 weight percent.

As can also be seen from Table A (comparing Control 1 to Example 6), the inclusion of 10 weight percent of the APG surfactant facilitates the preparation of a 74% solids content slurry (total weight basis) which has a viscosity equal to or less than that of the 67% solids 100% LAS surfactant based crutcher slurry and thereby makes possible, without attendant viscosity increase, a greater than 20% decrease in the crutcher slurry water content.

EXAMPLES 7–11

In these examples, a series of crutcher slurry formulations are prepared which correspond in composition to that of Example 2 above except that a 90:10 ratio mixture of a linear alkyl benzene sulfonate (LAS) surfactant with one of several different glucoside surfactants is employed in place of the Example 2 LAS and APG mixture and the viscosities of the resulting formulations are determined using a Brabender viscometer apparatus.

The recipes of the various formulations and the viscosity results for same are summarized in Table B below.

In these examples, the crutcher slurry formulations are prepared by first mixing together the water and those ingredients which are employed in the form of aqueous solutions (i.e., the LAS surfactant, the glucoside compound, and the sodium silicate) and heating the resulting mixture to 120° F. (48.9° C.) in a steam bath with stirring.

All of the dry ingredients except the sodium tripolyphosphate (STPP) thoroughly are dry blended together and are then added to the heated aqueous mixture. The STPP is then added with mild agitation and the resulting formulation is placed in the Brabender apparatus and is heated to a temperature of about 160° F. (71° C.) and the viscosity of said formulation is recorded as a function of time over a period of 1½ hours.

For comparative purposes, a control formulation (Control #2) is prepared and tested in which no glucoside surfactant is included.

TABLE B

| Example Number | Glucoside Compound Employed | Viscosity (Brabender Units[2]) Initial | After ½ Hour | After 1½ Hour |
|---|---|---|---|---|
| 7 | $C_{12-13}$ alkylpolyglucoside (average D.P.[1] of about 1.3) | 490 | 750 | 1,570 |
| 8 | $C_{9-11}$ alkylpolyglucoside (average D.P. of about 2.2–2.8) | 440 | 1,740 | 1,535 |
| 9 | $C_{9-11}$ alkylpolyglucoside (average D.P. of about 1.3) | 330 | 910 | 925 |
| 10 | 2-ethylhexyl polyglucoside (average D.P. of about 1.3) | 740 | 675 | 670 |
| 11 | $C_{12-13}$ alkylpolyglucoside (average D.P. of about 2.2–2.8) | 390 | 1,810 | 1,470 |
| Control 2 | None | 910 | 1,870 | 2,550 |

[1]D.P. = Degree of Polymerization
[2]Using a Brabender 700 cm g Head

EXAMPLE 12

In this example, the ability of a glucoside surfactant to prevent phase separation of ethoxylated fatty alcohol surfactant-based crutcher slurries is evaluated.

In conducting such evaluation, 54.7 parts by weight of an ethoxylated (7 moles ethylene oxide) $C_{12-15}$ fatty alcohol, 137.2 parts by weight of water and 27.3 parts by weight of an aqueous sodium silicate solution (46.5 weight percent active) are initially admixed with hand stirring and the following dry ingredients are added with continued stirring while heating to 170° F. (76.7° C.):

| | Parts by Weight |
|---|---|
| Sodium tripolyphosphate | 76.65 |
| Carboxymethyl cellulose | 1.84 |
| Sodium chloride | 34.12 |
| Sodium sulfate (anhydrous) | 146.74 |

Even with continued hand stirring and heating, a homogeneous mixture is not achieved and, upon standing without stirring, the mixture separates into two distinct, dissimilar layers.

The addition of 36.5 parts by weight of a 50 weight percent aqueous solution of a $C_{12-13}$ alkylpolyglucoside (D.P. of about 2.2–2.8) with mild agitation (i.e., hand stirring) rapidly converts the previously phase-separated mixture into a homogeneously suspended product.

Further experimentation in accordance with the foregoing procedure using smaller quantities of the alkyl polyglucoside material shows that the addition of as little as about 2 weight percent of same (surfactant weight basis) is sufficient to provide a homogeneously suspended crutcher slurry product.

EXAMPLE 13

Example 12 is repeated using an ethoxylated (13 moles ethylene oxide) $C_{14-15}$ fatty alcohol nonionic surfactant in place in the one employed in Example 12.

Experimentation shows that the use of the glucoside surfactant in a ratio of at least about 0.5 part per 1 part of the ethoxylated alcohol is needed to provide a homogeneous crutcher slurry in the case of this particular ethoxylated alcohol surfactant.

EXAMPLES 14 AND 15

Example 13 is repeated using different glucoside surfactants in place of the $C_{12-13}$, D.P. 2.2–28 material of Example 13.

Experimentation shows that 2-ethylhexyl polyglucoside (D.P. of about 1.3) provides homogeneous crutcher slurries at usage levels of from about 10 to 20 percent on a total surfactant weight basis.

A $C_{9-11}$ alkylpolyglucoside (D.P. of about 2.2–2.8) is also observed to provide a homogeneous crutcher slurry at a usage level of about 10 percent on a total surfactant ingredient weight basis.

While the present invention has been described and illustrated by reference to certain specific embodiments and examples thereof, such is not to be interpreted as in any way limiting the scope of the instantly claimed invention.

What is claimed is:

1. A process for the preparation of a particulate detergent composition which comprises the steps of:

A. forming an aqueous crutcher slurry comprising, per 100 parts of total crutcher slurry weight:

1. from about 40 to about 80 parts by weight of solid ingredients, said solid ingredients comprising:
   a. from about 2 to about 60 parts by weight of a surfactant ingredient at least about 0.1 weight percent of which is a glycoside surfactant, said glycoside surfactant constituting less than about 2 weight percent of said solid ingredients on a total dry solids weight basis;
   b. from about 5 to about 70 parts by weight of a builder ingredient; and
   c. from 0 to about 40 parts by weight of a water soluble filler ingredient; and
2. from about 20 to about 60 parts by weight of water; and B. drying said crutcher slurry to form said particulate detergent composition.

2. The process of claim 1 wherein the glycoside surfactant is employed in an amount ranging from about 1 to about 50 weight percent on a surfactant ingredient weight basis.

3. The process of claim 2 wherein the surfactant ingredient comprises, on a total surfactant ingredient weight basis, at least about 50 weight percent of an anionic surfactant.

4. The process of claim 3 wherein the glycoside surfactant is employed in an amount sufficient to measurably reduce the crutcher slurry viscosity relative to that viscosity which it would have had in the absence of said glycoside surfactant.

5. The process of claim 4 wherein the total solids content of said crutcher slurry is from about 50 to about 80 weight percent on a total weight basis.

6. The process of claim 2 wherein the surfactant ingredient comprises, on a total surfactant ingredient weight basis, at least about 50 weight percent of an alkoxylated alcohol nonionic surfactant.

7. The process of claim 6 wherein the glycoside surfactant is employed in an amount sufficient to substantially improve the homogeneity of the crutcher slurry relative to what it would have been in the absence of said glycoside surfactant.

8. The process of claim 7 wherein the total solids content of said crutcher slurry is from about 50 to about 80 weight percent on a total weight basis.

9. The process of claim 7 wherein the alkoxylated alcohol nonionic surfactant is an ethoxylated $C_8$–$C_{22}$ straight or branched chain alcohol comprising an average of from about 2 to about 20 ethylene oxide groups per molecule of said nonionic surfactant.

10. The process of claim 9 wherein the alkoxylated alcohol non-ionic surfactant is an ethoxylated $C_{12-18}$ fatty alcohol comprising an average of from about 5 to about 15 ethylene oxide groups per molecule of said nonionic surfactant.

11. The process of claim 1 wherein the glycoside surfactant corresponds to the formula:

$$RO—R^1O—_y(Z)_x \qquad A$$

wherein R is a monovalent organic radical containing from about 6 to about 30 carbon atoms; $R^1$ is a divalent hydrocarbon radical containing from about 2 to about 4 carbon atoms; O is an oxygen atom; y is a number having an average value of from 0 to 12; Z is a moiety derived from a reducing saccharide containing 5 or 6 carbon atoms; and x is a number having an average value of from 1 to about 10.

12. The process of claim 11 wherein, in the glycoside surfactant of the Formula A, R is a monovalent organic radical containing from about 8 to about 18 carbon atoms; y is zero; Z is glucose or a moiety derived therefrom; X is a number having an average value of from 1½ to about 4.

13. The process of claim 12 wherein the predominant surfactant ingredient is an anionic surfactant and wherein the glycoside surfactant is employed in an amount ranging from about 2 to about 25 weight percent on a total surfactant ingredient weight basis.

14. The process of claim 13 wherein the anionic surfactant is a linear alkyl benzene sulfonate.

15. The process of claim 1 wherein the crutcher slurry comprises:

a. from about 4 to about 25 parts by weight of the surfactant ingredient, about 1 to about 50 weight percent of which is the glycoside surfactant;
b. from about 12 to about 28 parts by weight of the builder ingredient;
from 0 to about 32 parts by weight of said filler ingredient; and
d. from about 25 to about 50 parts by weight of water.

16. The process of claim 15 wherein the filler ingredient is sodium sulfate.

17. The process of claim 1 wherein the drying step is accomplished by spray drying.

18. The process of claim 17 wherein the particulate detergent composition produced is powdery or granular in character.

* * * * *